US006434352B1

(12) United States Patent
Castelli

(10) Patent No.: US 6,434,352 B1
(45) Date of Patent: Aug. 13, 2002

(54) LIQUID INK DEVELOPMENT (LID) MACHINE HAVING A FLUID FILM THICKNESS CONTROL APPARATUS

(75) Inventor: Vittorio Castelli, Yorktown Heights, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/733,721

(22) Filed: Dec. 11, 2000

(51) Int. Cl.[7] ..... G03G 15/10
(52) U.S. Cl. ..... 399/237
(58) Field of Search ..... 399/57, 235, 237, 399/239

(56) References Cited

U.S. PATENT DOCUMENTS 4,707,112 A 11/1987 Hartmann
5,157,443 A 10/1992 Anderson et al.
5,619,313 A 4/1997 Domoto et al. ..... 399/233
6,061,540 A * 5/2000 Takeda ..... 399/237

* cited by examiner

*Primary Examiner*—William J. Royer
(74) *Attorney, Agent, or Firm*—Tallam I. Nguti

(57) ABSTRACT

Apparatus is provided for controlling a thickness (h) of a film of development fluid within a development nip of a liquid ink development (LID) machine. The apparatus includes a first moveable member having a first velocity (V1) and a path of movement defining a radius of curvature (R) for forming a long development nip. It also includes a second moveable member mounted partially about the first moveable member for forming the long development nip, and having a second velocity (V2) as well as a tension (T). The apparatus further includes a mechanism for introducing into the long development nip liquid development fluid having a viscosity ($\mu$), and a programmed controller connected to the first moveable member and the second moveable member, for controlling the first velocity (V1), the second velocity (V2), and the tension (T) so that $h=K1R\{K2\ \mu(V1+V2)]/T\}^{2/3}$, where K1 and K2 are each a constant.

10 Claims, 2 Drawing Sheets

LIQUID INK DEVELOPMENT (LID) MACHINE HAVING A FLUID FILM THICKNESS CONTROL APPARATUS

BACKGROUND OF THE INVENTION

This invention relates to electrostatographic printing machines, and more particularly to a liquid ink development (LID) electrostatographic printing machine having a fluid film thickness control apparatus for controlling the development nip gap, and hence thickness of liquid developer material or development fluid in the development nip, of such a machine.

A typical electrostatographic printing machine employs a photoconductive member that is sensitized by charging to a substantially uniform potential. The charged portion of the photoconductive member is exposed to the light image of a document. Exposure of the charged photoconductive member selectively dissipates the charge to record an electrostatic latent image. The electrostatic latent image corresponds to the informational areas of the document. The electrostatic latent image recorded on the photoconductive member is developed by contact with a developer material or development fluid. The developer material or development fluid can be a dry material comprising carrier granules having adhering toner particles. The latent image attracts the toner particles from the carrier granules to form a toner powder image on the photoconductive surface. The toner powder image is then transferred and permanently fused to a copy sheet.

An electrostatic latent image also may be developed with a liquid developer material or development fluid. In a liquid development system, the photoconductive member is contacted with an insulating liquid carrier having dispersed finely divided marking particles. The electrical field associated with the electrostatic latent image attracts the marking particles to the photoconductive member to form a visible image.

Liquid developing imaging processes utilize a liquid developer typically having about 2 percent by weight of fine solid particulate toner material dispersed in a liquid carrier. The liquid carrier is typically a hydrocarbon. In the developing process, the image is transferred to a receiver which may be an intermediate belt. The image on the photoconductive member contains about 12 weight percent of particulate toner in liquid hydrocarbon carrier. In order to improve the quality of transfer of a developed image to a receiver, the percent solids in the liquid should be increased to about 25 percent by weight. Increase in percent solids may be achieved by removing excess hydrocarbon liquid. However, excess hydrocarbon liquid must be removed in a manner that results in minimum degradation of the toner image.

Prior art liquid ink development systems operate such that a photoconductor surface rotates through a developer bath to make contact with the toner. In these systems, toner particles are attracted to a latent electrostatic image on the photoconductor surface. The motion of the toner particles in an imagewise electric field is generally called electrophoresis and is well known in the art. However, a liquid carrier also wets the photoconductor surface. It is very difficult to transfer a toner image to paper without either first removing the liquid carrier from the photoconductor surface or using the liquid carrier to enable transfer to the paper and subsequently removing the liquid carrier from the paper. In both cases, the liquid carrier must be removed by processes that must include evaporation of the liquid carrier into the air, which causes airborne pollution.

U.S. Pat. No. 4,707,112, to Hartmann, Nov. 17, 1987, relates to an apparatus for developing an electrostatic latent image. The apparatus includes means for furnishing liquid developer material or development fluid to the image in a development zone and means for dispersing the particles substantially uniformly in the liquid carrier of the liquid developer material or development fluid at the entrance to the development zone so as to deflocculate marking particles. The dispersing means may comprise means for generating a pulsed electrical field in the developer material or development fluid at the entrance to the development zone to induce movement of the marking particles and the liquid carrier. The generating means includes an electrode positioned at the entrance to the development zone and means for applying a pulsed voltage to the electrode to generate a pulsed electrical field in the developer material or development fluid.

U.S. Pat. No. 5,157,443 to Anderson et al, Oct. 20, 1992 relates to liquid development of latent images produced on a movable image retention belt for high speed reproducing machines by using a moving belt applicator to define a development zone having a uniform gap with an extended length. This disclosure requires the gap to be set and controlled by the accuracy of the parts involved and their mounting arrangements.

U.S. Pat. No. 5,619,313 to Domoto et al, Apr. 8, 1997, relates to a method and apparatus for simultaneously developing and transferring a liquid toner image by moving a latently imaged photoreceptor and a biased intermediate transfer member into a process nip forming a relationship. The method further includes the step of introducing charged liquid toner into the process nip, such that liquid toner sandwiched within the nip simultaneously develops image portions of the latent image onto the intermediate transfer member, and background portions of the latent image onto the charged bearing surface of the photoreceptor.

In any LID machine as described above, the process speed or rate of image development is a function of the electrostatic field within the development nip, of the toner particle size and electric charge, and of the viscosity of the carrier fluid or liquid developer material or development fluid. Higher process speeds and higher developer material or development fluid viscosities demand smaller development nip gaps and longer development nips or zones. Effective control of such nip gaps by attempting to accurately position external parts has been found to be relatively difficult and expensive due in part to the mechanical tolerances involved.

There is therefore a need for a comparatively easy and less costly approach to accurately controlling process speeds by controlling the development nip gap, and hence thickness of liquid developer material or development fluid in the development nip, of such a machine

SUMMARY OF THE INVENTION

In accordance with the present invention, there is provided apparatus for controlling a thickness (h) of a film of development fluid within the development nip of a liquid ink development (LID) machine. The apparatus includes a first moveable member having a first velocity (V1) and a path of movement defining a radius of curvature (R) for forming a long development nip. It also includes a second moveable member mounted partially about the first moveable member for forming the long development nip, and having a second velocity (V2) as well as a tension (T). The apparatus further includes a mechanism for introducing into the long development nip liquid development fluid having a viscosity ($\mu$), and a programmed controller connected to the first moveable member and the second moveable member, for controlling the first velocity (V1), the second velocity (V2), and the tension (T) so that $h=K1R\{K2\mu(V1+V2)]/T\}^{2/3}$, where K1 and K2 are each a constant.

Other features of the present invention will become apparent from the following drawings and description.

BRIEF DESCRIPTION OF THE DRAWINGS

In the detailed description of the invention presented below, reference is made to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
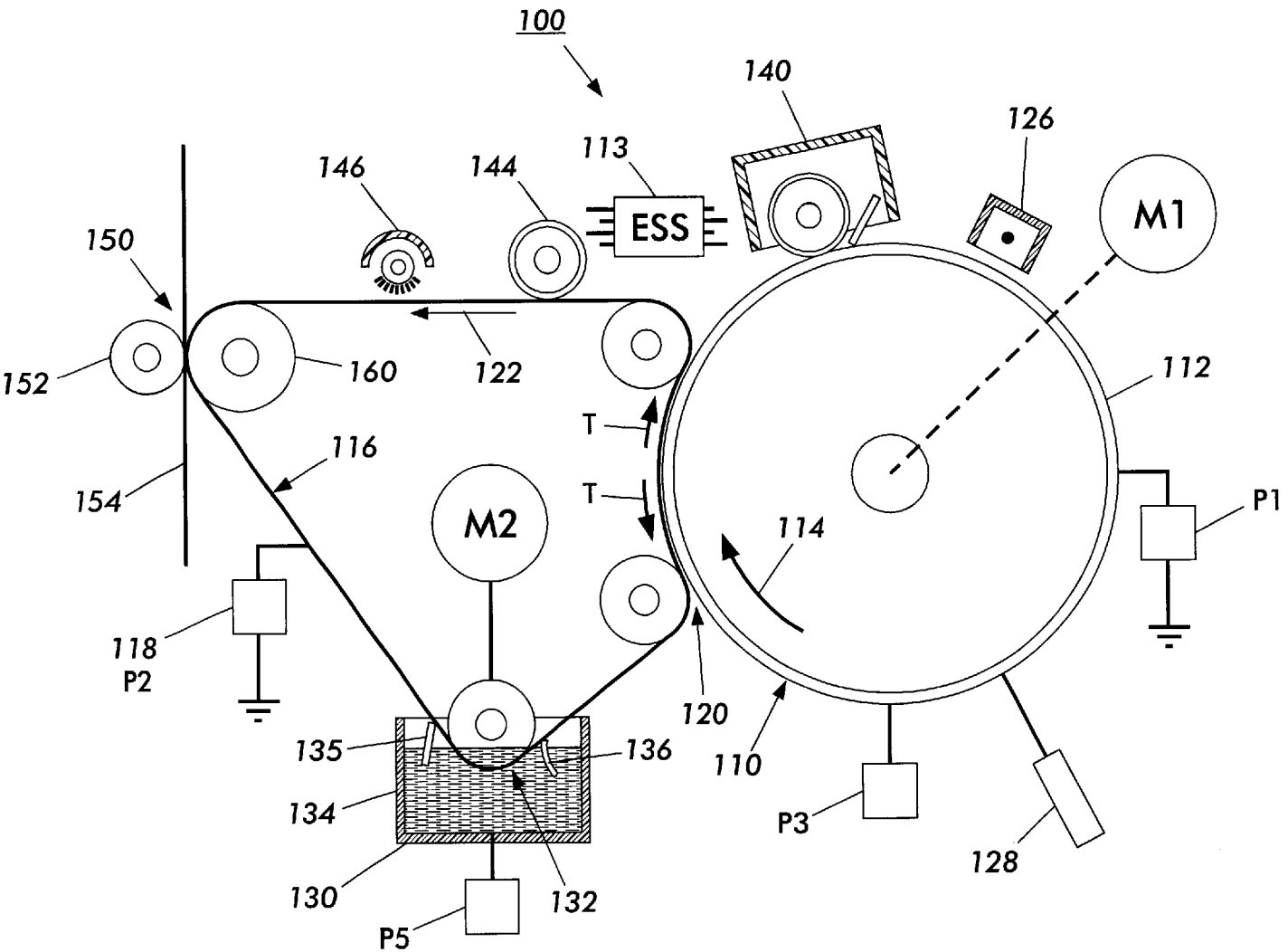
FIG. 1 is a schematic illustration of a liquid electrophotographic reproduction machine including apparatus for controlling a thickness (h) of a film of development fluid within a development nip in accordance with the present invention.

Referring now to FIG. 1, a liquid electrophotographic reproduction machine 100, including apparatus for controlling a thickness (h) of a film of development fluid wherein a development nip in accordance with the present invention, is illustrated. As shown, the reproduction machine 100 includes a movable latent image bearing member 110 that has a charge bearing surface 112. The latent image bearing member 110 for example can be a drum rotatable about an axis in the direction of the arrow 114, as shown, by a first drive or moving means M1 and at a first velocity (V1).

Equally, the latent image bearing member 110 can also be a continuous flexible belt that is trained over a series of rollers, and is movable in the same direction as shown. According to the present invention, the latent image bearing member 110 can be any suitable charge and image bearing member, even one suitable for ionographic latent image formation. In either case, the latent image bearing member 110 may be maintained at an uncharged, first electrical potential shown as P1.

The reproduction machine 100 also includes a movable intermediate toner image receiving and transfer member 116 that is biased to a second electrical potential P2 shown for example as ground 118. Importantly according to the present invention, a portion of the intermediate transfer member 116 is wrapped over a portion of the charge bearing surface 112 to form a long process nip 120 (having a gap spacing "h" FIG. 2) with the charge bearing surface 112 of latent image bearing member 110. The intermediate transfer member 116 is electrically conductive, or it can be comprised of a dielectric substrate that has an electrically conductive overcoating.

According to the present invention, at least the latent image bearing member 110 or the intermediate transfer member 116 has to be flexible in order to produce the process nip 120. Accordingly, the intermediate transfer member 116 is shown as a flexible belt that is trained and held in controlled tension about a series of rollers for example, and is movable in the direction of the arrow 122 by a second drive or moving means M2.

As shown, it is important that within the process nip 120, the intermediate transfer member 116 is being moved by the second moving means M2 in the same direction as the charge bearing surface 112 of the latent image bearing member 110, and at a second velocity (V2). The second velocity (V2) may be equal to the first velocity (V1) so as to achieve synchronous movement of the charge bearing surface 112 and the intermediate transfer member 116 through the process nip 120.

Preferably, the process nip 120 has a radius of curvature, and the movable intermediate transfer member 116 has and follows a concave path through the curvature of the nip, as shown. As such, charge bearing surface or latent image bearing and photoconductive surface 112 of the latent image bearing member 110 therefore has and follows a convex path as shown within the process nip 120.

In accordance with the present invention, the reproduction machine 100 also includes means for forming a latent image electrostatically on the charge bearing surface 112. The means for forming a latent image can be ionographic, or as shown, it can be electrostatic, and so includes (a) a corona generating device 126 for applying a uniform layer of charge having a desired third electrical potential P3, and a desired polarity, for example a negative polarity, onto the charge bearing surface 112 of latent image bearing member 110. The means for forming a latent image electrostatically also includes discharging means 128 for imagewise discharging portions of the uniformly charged charge bearing surface 112 to form a desired latent image.

The latent image is so formed such that it includes, for example, undischarged image areas (as in a CAD process) which each have the third electrical potential P3, and discharged background areas which each have the same electrical potential P1 as the uncharged latent image bearing member 110. The first, second and third electrical potentials P1, P2, and P3 are selected such that P2, the potential of the intermediate transfer member 116, lies between P1 and P3 of the latent image bearing member 110, so as to combine with charged liquid toner (as will be described below) to create electrical fields within the process nip 120 for simultaneous development and transfer of liquid toner images according to the present invention.

Alternatively, the latent image can also be so formed such that it includes, for example, discharged image areas (as in a DAD process) which each have the same electrical potential P1 as the uncharged latent image bearing member 110, and undischarged background areas which each have the third electrical potential P3. As such, the imagewise discharged portions of the charge bearing surface 112 comprise the image areas of the latent image, and the imagewise undischarged portions of the charge bearing surface 112 comprise the background areas of the latent image.

Further in accordance with the present invention, the reproduction machine 100 includes means 130 for introducing liquid developer material or development fluid including charged liquid toner 132 into the gap spacing "h" of the process nip 120. As shown, for example, the means 130 includes a source 134 of charged liquid toner or ink which preferably has a solids content between 2%–25% by volume. In a CAD process, i.e. charged area development process, the charged liquid toner 132 has a potential P5 and a polarity that are relatively the same as those of the first, uncharged, electrical potential P1 of charge bearing surface 112, and that are relatively opposite to those of the third, charged electrical potential P3 of charge bearing surface 112.

The source 134 can be a liquid developer unit including a cleaning blade 135, and a metering blade 136. The means 130 also includes, according to the present invention, the intermediate transfer member 116 which is moved through the liquid developer unit 134 to receive a uniform coated layer of liquid toner for transport through the gap "h" of the process nip 120. Accordingly, the means 130 for introducing charged liquid toner into the process nip 120 includes means 134, 136 and 116 for applying a uniform coating of liquid toner onto the intermediate transfer member 116, at a point upstream of the process nip 120, relative to movement of the intermediate transfer member 116.

Further in accordance with the present invention, as shown in FIG. 1, the reproduction machine 100 includes a cleaning apparatus 140, an image conditioning roll 144, an image dryer 146, a transfuse nip 150 through which an image receiving substrate 154 is moved. As shown, the transfuse nip 150 is formed by a fusing roll 160 behind the intermediate transfer member 116, and a backup roll 152.

Figure 2:
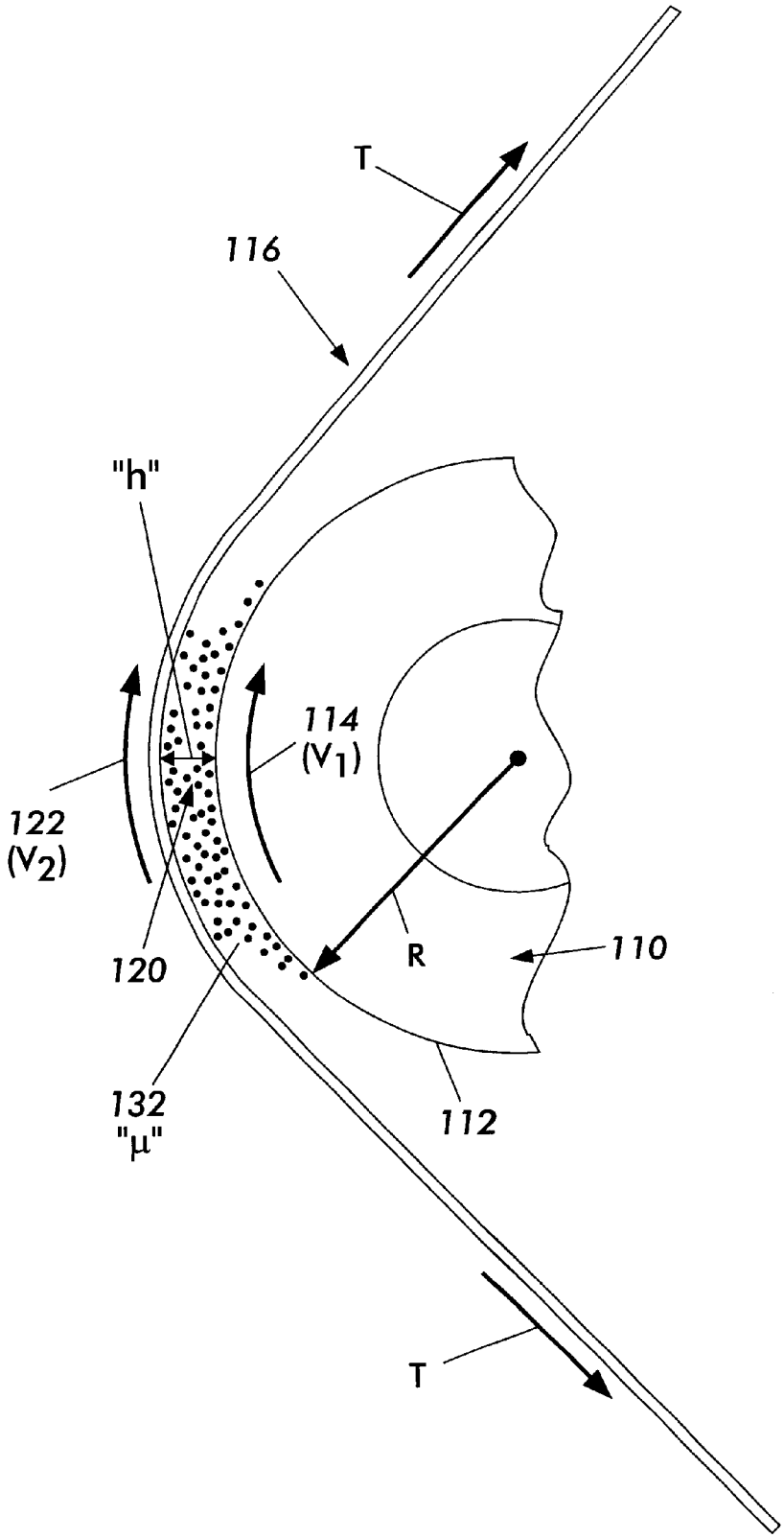
FIG. 2 is an enlarged schematic of the process nip of FIG. 1 showing the apparatus for controlling a thickness (h) of a film of development fluid within the development nip in accordance with the present invention.

Referring now to FIGS. 1–2, the layer or fluid film of liquid toner brought into gap "h" of the process nip 120 on the surface of intermediate transfer member 116 is there sandwiched between the intermediate transfer member 116 and the charge bearing surface 112 as both move through the process nip 120, in the presence of electrical fields set up due to the various potentials P1 to P4 or P5. As disclosed in U.S. Pat. No. 5,619,313 to Domoto et al, Apr. 8, 1997, simultaneous develop-and-transfer occurs in which toner solids representative of the image areas of the latent image will form and be held electrostatically on the intermediate transfer member 116, and toner solids representative of the background areas of the latent image will form and be held electrostatically onto the charge bearing surface 112.

In accordance with the present invention, for controlling the gap, and hence the thickness ("h") of a film of development fluid within the process nip or development nip 120, the apparatus or liquid ink development (LID) machine 100 includes the charge bearing surface as a first moveable member 112 having a first velocity (V1) and a path of movement defining a radius of curvature (R) for forming the long process nip or development nip 120. The apparatus or LID machine also includes the intermediate transfer member as a second moveable member 116 mounted partially about the first moveable member 112 for forming the long development nip 120. The second moveable member 116 has a second velocity (V2) and a tension (T) in each leg thereof to either side of the development nip 120. The apparatus or LID machine 100 includes a mechanism 116, 132 for introducing into the long development nip 120, charged liquid toner or liquid development fluid 132 having a viscosity ($\mu$). The apparatus or LID machine 100 further includes a programmed controller (ESS) 113 (FIG. 1) that is connected to the first moveable member 112 and the second moveable member 116 and is programmed for controlling the first velocity (V1), the second velocity (V2), and the tension (T) so that $h=K1R\{K2\mu(V1+V2)]/T\}^{2/3}$, where K1 and K2 are each a constant.

In accordance with the present invention, K1 is within a range of 0.50–0.80 , and preferably K1 is 0.65, and K2 is within a range of 5–7, and preferably 6. As such, the programmed controller 113 is programmed for controlling the first velocity (V1), the second velocity (V2), and the tension (T) so that $h=0.65R\{6\mu(V1+V2)]/T\}^{2/3}$.

Further, in accordance with the present invention, V1 and V2 have the same direction within the long development nip. Where as illustrated, the first moveable member 112 has a cylindrical cross-section and the second moveable member 116 is a flexible belt, the flexible belt is mounted about a plurality of rollers and forms a wrap angle about the first moveable member 112. In accordance with an aspect of the present invention, it is preferable that the wrap angle so formed be at most six degrees about the circumference of the first moveable member 112.

Thus in accordance with the present invention, the gap "h", and hence the thickness of the film of development fluid with the long development nip 120 is effectively being controlled by the programmed controller 113 as a function of the velocities of the parts, the viscosity of the development fluid, and the tension of the image bearing member or photoreceptor or intermediate transfer member or developer belt acting according to the principles of self-acting lubrication. As illustrated in FIG. 2, the dimension of the nip gap, "h", is greatly exaggerated in order to render it visible. The belt tension is indicated by T. It should be noted either one of the first or the second moveable members 112, 116 can be the image bearing member and the other the developer belt. If the gap "h" is flooded with development fluid and either one or both of the first moveable member and second moveable member are in motion, a separation is established according to the principles of hydrodynamic lubrication.

It should also be noted that aside from small deviations at the four edges of the gap "h" and for wrap angles greater than 6 degrees, the spacing, "h", between the developer belt 116 and the charge bearing surface or cylinder 112, is uniform and is approximately equal to $h=0.65R\{6\mu(V1+V2)]/T\}^{2/3}$ where $\mu$ is the absolute viscosity of the development fluid. It is also important to note that the velocities V1 and V2 add algebraically as indicated. This is because equal and opposite velocities will produce no film support.

Thus in accordance with the present invention, and as an example, for belt controlled at a tension (T) of 1 pound per inch of width, a development fluid having a viscosity of 10 centipoise, a cylinder of 2 inches diameter (i.e. R of one inch), and a total velocity V1+V2) of 17 inches per second, the equation to $h=0.65R\{6\mu(V1+V2)]/T\}^{2/3}$ will produce a satisfactory gap "h", and hence fluid film thickness, of 0.0019 inches (49 microns).

In order to minimize damage when the machine starts its movement, the cylinder and the belt could be started at the same rate up to process speed then the velocity of one of the two first moveable member and second moveable member could be changed to the desired value. If this maneuver requires passing through equal and opposite velocities, this should be accomplished rapidly to avoid film collapse.

As can be seen, there has been provided apparatus for controlling a thickness (h) of a film of development fluid within the development nip of a liquid ink development (LID) machine. The apparatus includes a first moveable member having a first velocity (V1) and a path of movement defining a radius of curvature (R) for forming a long development nip. It also includes a second moveable member mounted partially about the first moveable member for forming the long development nip, and having a second velocity (V2) as well as a tension (T). The apparatus further includes a mechanism for introducing into the long development nip development fluid having a viscosity ($\mu$), and a programmed controller connected to the first moveable member and the second moveable member, for controlling the first velocity (V1), the second velocity (V2), and the tension (T) so that $h=K1R\{K2\mu(V1+V2)]/T\}^{2/3}$, where K1 and K2 are each a constant.

While the present invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. Apparatus for controlling a thickness (h) of a film of development fluid within a development nip of a liquid ink development (LID) machine, the apparatus comprising:

(a) a first moveable member having a first velocity (V1) and a path of movement defining a radius of curvature (R) for forming a long development nip:

(b) a second moveable member mounted partially about said first moveable member for forming said long development nip, said second moveable member having a second velocity (V2) and a tension (T);

(c) a mechanism for introducing into said long development nip liquid development fluid having a viscosity ($\mu$) ;and (d) a programmed controller connected to said first moveable member and to said second moveable member for controlling said first velocity (V1), said second velocity (V2), and said tension (T) so that $h=K1R\{K2\ \mu(V1+V2)]/T\}^{2/3}$, where K1 and K2 are each a constant.

2. The apparatus of claim 1, wherein K1 is within a range of 0.50–0.80.

3. The apparatus of claim 2, wherein K1 is 0.65.

4. The apparatus of claim 1, wherein K2 is within a range of 5–7.

5. The apparatus of claim 4, wherein K2 is 6.

6. The apparatus of claim 1, wherein V1 and V2 have the same direction within said long development nip.

7. The apparatus of claim 1, wherein said first moveable member has a cylindrical cross-section.

8. The apparatus of claim 1, wherein said second moveable member is a flexible belt.

9. The apparatus of claim 8, wherein said flexible belt is mounted about a plurality of rollers and forms a wrap angle about said first moveable member.

10. The apparatus of claim 9, wherein said flexible belt forms a wrap angle of at most six degrees about said first moveable member.

* * * * *